US006015307A

United States Patent [19]

Chiu et al.

[11] Patent Number: 6,015,307

[45] Date of Patent: Jan. 18, 2000

[54] ELECTRIC OUTLET WITH ROTARY SOCKET BODIES

[76] Inventors: Pen-Fu Chiu, 6F., Alley 7, Lane 270, No. 9-1, Chung Pin Rd.; Chin-Shen Su, 5F., Alley 5, Lane 28, No. 1, Ho Kang I Rd., both of Hsinchuan City, Taipei Hsien, Taiwan

[21] Appl. No.: 09/176,437

[22] Filed: Oct. 21, 1998

[51] Int. Cl.[7] ..... H01R 13/44

[52] U.S. Cl. ..... 439/139; 439/188; 200/51.09

[58] Field of Search ..... 439/188, 107, 439/650, 135; 200/51.09, 51.17, 51 R

[56] References Cited

U.S. PATENT DOCUMENTS

| | | | |
|---|---|---|---|
| 4,525,610 | 6/1985 | Le Magourou | 200/51.13 |
| 5,425,659 | 6/1995 | Banks | 439/650 |
| 5,429,518 | 7/1995 | Chen | 439/188 |
| 5,472,350 | 12/1995 | Mehta | 439/107 |
| 5,526,225 | 6/1996 | Wang | 361/643 |

*Primary Examiner*—Steven L. Stephan
*Assistant Examiner*—J. F. Duverne
*Attorney, Agent, or Firm*—Dougherty & Troxell

[57] ABSTRACT

An electric outlet includes a casing having a longitudinal row of split bolts on the middle and two longitudinal row of locating blocks at two opposite sides of the split bolts, a grounding strip and two metal conductive strips respectively fastened to the longitudinal row of split bolts and the longitudinal rows of the locating block and respectively connected to the conductors of the three wires of a three-wire electric wire, a plurality of rotary socket bodies respectively and rotatably mounted on the split bolts, each rotary socket body having insertion slots for receiving the metal blade and grounding prong of an electric plug, and a cover shell covered on the casing to hold the rotary socket bodies in place, wherein when an electric plug is installed in one rotary socket body, the rotary socket body can be rotated on the respective split bolt between "ON" and "OFF" positions.

8 Claims, 5 Drawing Sheets

ELECTRIC OUTLET WITH ROTARY SOCKET BODIES

BACKGROUND AND SUMMARY OF THE INVENTION

The present invention relates to electric outlet, and more particularly to such an electric outlet which comprises a plurality of rotary socket bodies for receiving a respective electric plug that can be separately rotated to shift the respective electric plug between "ON" position and "OFF" position.

An electric outlet is generally comprises a plurality of socket bodies for receiving a respective electric plug, and an On/Off switch controlled to switch on/off the socket bodies. Because the socket bodies are fixedly connected in series to the electric wire through the On/Off switch, the socket bodies are simultaneously turned on or off when the On/Off switch is switched, that is the socket bodies can not be separately controlled. FIG. 6 shows a conventional electric outlet which eliminates this problem. This structure of electric outlet is comprised of a casing, a cover shell, two metal conductive strips, a grounding strip, and a plurality of rotary socket bodies. The metal conductive strips each have a plurality of longitudinally spaced through holes respectively coupled to respective locating rods inside the casing. After installation of the metal conductive strips, the locating rods are infused to form a respective head, causing the metal conductive strips to be firmly secured in place. The grounding strip is mounted in a longitudinal groove inside the casing, and covered with an insulative strip at the top. The rotary socket bodies each have metal contact elements fastened thereto by screw means. When in use, the socket bodies can be separately rotated between "ON" and "OFF" positions. This structure of electric outlet is complicated, therefore its manufacturing cost is high. Furthermore, the electric outlet is vibrated or receives a downward pressure, the metal contact elements of the rotary socket bodies tend to be forced out of position, causing a contact error.

The present invention has been accomplished to provide an electric outlet which eliminates the aforesaid drawbacks. It is one object of the present invention to provide an electric outlet with multiple socket bodies which allows the socket bodies thereof to be separately rotated between "ON" position and "OFF" position. It is another object of the present invention to provide an electric outlet which has a simple structure, and is easy to be assembled. The achieve these and other objects of the present invention, there is provided an electric outlet comprised of a rectangular, top-open casing having a longitudinal row of male coupling elements on the middle and two longitudinal rows of locating blocks at two opposite sides of the longitudinal row of male coupling elements; a cover shell covered on the casing, the cover shell having a plurality of socket holes longitudinally arranged in a line; a plurality of rotary socket bodies respectively mounted in the casing, the rotary socket bodies each having a bottom female coupling means respectively coupled to the male coupling elements of the casing, a flat circular head respectively inserted into the socket holes on the cover shell, and two metal blade insertion slots and one grounding prong insertion slot provided at the flat circular head and adapted to receive the metal blades and grounding prong of an electric plug; a grounding strip longitudinally mounted in the casing on the middle for connection to the grounding wire of the electric wire to be used with the electric outlet, the grounding strip comprising a plurality of longitudinally spaced through holes, which receive the male coupling elements of the casing, and electric contact means respectively disposed at two opposite sides of each through hole and longitudinally aligned for receiving the grounding prong of an electric plug; and two metal conductive strips mounted in the casing and longitudinally arranged in parallel at two opposite sides of the grounding strip for connection to the hot wire and neutral wire of the electric wire to be used with the electric outlet, the metal conductive strips each having a plurality of longitudinally spaced coupled units respectively coupled to the locating blocks of the casing; wherein when the metal blades and grounding prong of an electric plug are inserted into the metal blade insertion slots and grounding prong insertion slot of one of the rotary socket bodies, the rotary socket body can be rotated on the respective male coupling element inside the casing and retained between "ON" position to hold the metal blades and grounding prong of the installed electric plug in contact with the coupling units of the metal conductive strips and the electric contact means of the ground stirp, and "OFF" position to disconnect the metal blades and grounding prong of the installed electric plug from the coupling units of the metal condutive strips and the electric contact means of the grounding strip.

DETAILED DESCRIPTION OF THE PREFERRED EMBODIMENT

Figure 1:
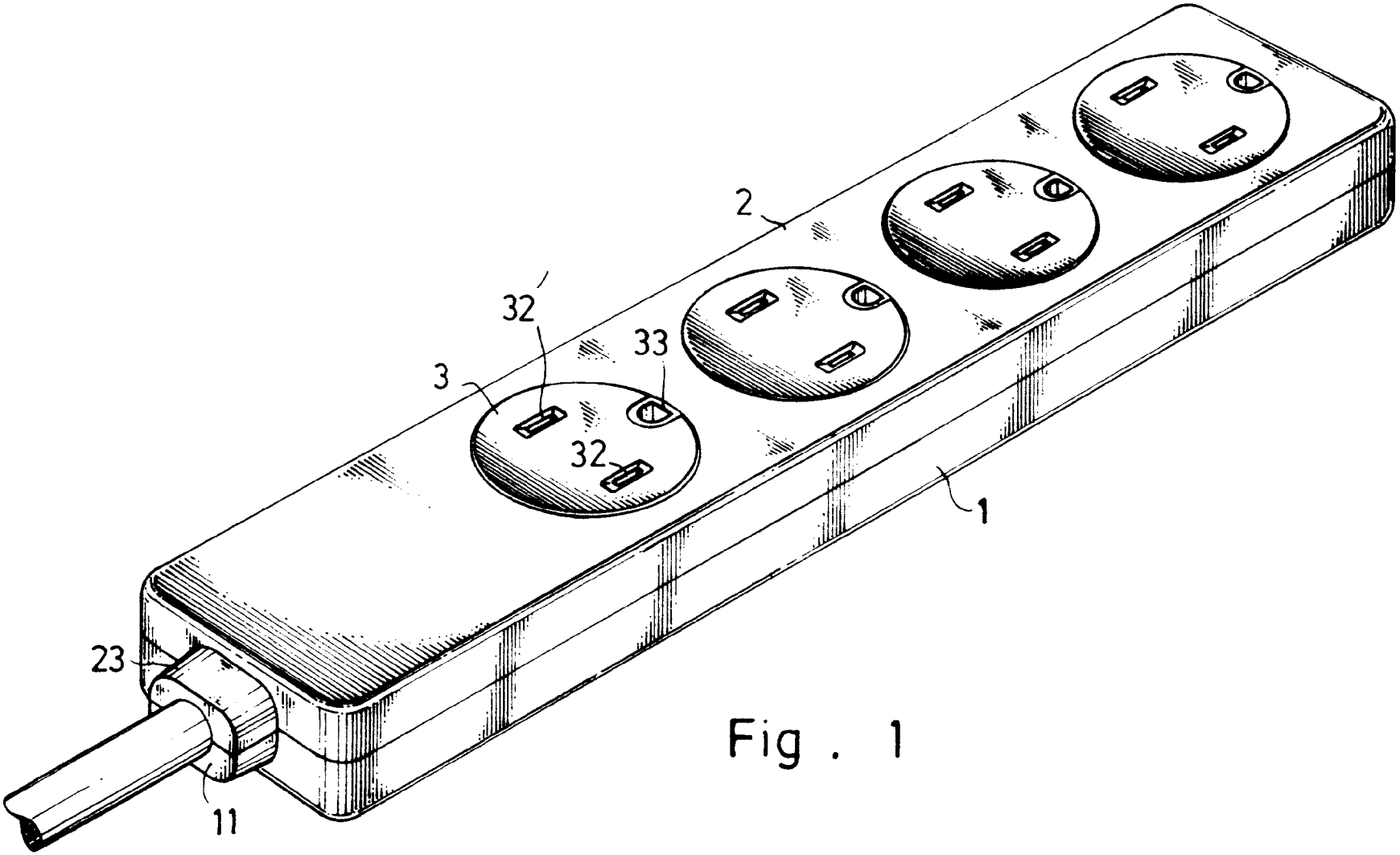
FIG. 1 is a perspective view of an electric outlet according to the present invention.
Figure 2:
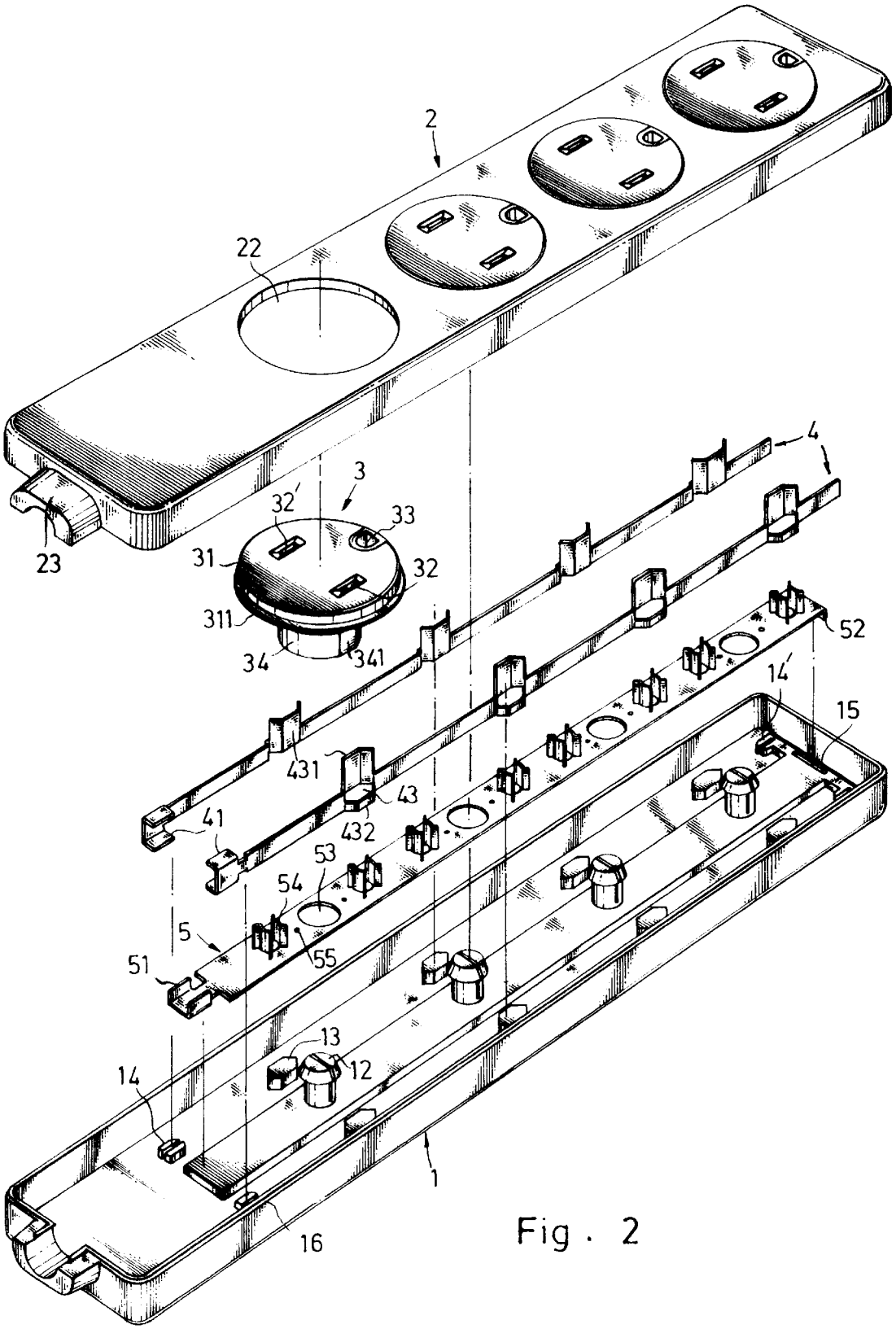
FIG. 2 is an exploded view of the electric outlet shown in FIG. 1.

Referring to FIGS. from 1 through 4, an electric outlet in accordance with the present invention is generally comprised of a casing 1, a cover shell 2, a plurality of rotary socket bodies 3, two metal conductive strips 4, and a grounding strip 5.

The casing 1 is a rectangular, top-open box comprising an arched neck 11 at one side through which a three-wire electric wire is inserted into the casing 1 with the conductors of its three wires respectively connected to the metal conductive strips 4 and the grounding strip 5, a plurality of upright split bolts 12 raised from the bottom side wall thereof on the inside on the middle and longitudinally arranged in a line for holding the grounding strip 5 inside the casing 1, a plurality of upright hexagonal locating blocks 13 raised from the bottom side wall on the inside and longitudinally arranged in two lines and respectively bilaterally spaced from the upright split bolts 12, two longitudinally grooved front positioning blocks 14 and two longitudinally grooved rear positioning blocks 14' respectively provided at the bottom side wall on the inside near top and rear ends and in alignment with the two longitudinal row of the upright hexagonal locating blocks 13 for securing the metal conductive strips 4 inside the casing 1, a recessed retaining hole 15 provided at the bottom side wall on the inside near the rear end between the longitudinally grooved rear positioning blocks 14', and a peripheral coupling groove 16 disposed around the periphery at the top.

The cover shell 2 fits the casing 1, comprising a plurality of socket holes 22 longitudinally arranged in a line for receiving the rotary socket bodies 3 respectively in a flush manner, an arched neck 23 at one end fitting the arched neck 11 of the casing 1, and a peripheral coupling flange 21 disposed around the peripheral at the bottom for coupling to the peripheral coupling groove 16 at the casing 1.

The rotary socket bodies 3 each comprise a cylindrical base 34, a flat circular top 31 integral with the cylindrical base 34 at the top, a stop flange 311 raised around the periphery of the flat circular top 31, two metal blade insertion slot 32, 32' and a grounding prong insertion slot 33 provided at the flat circular top 31 for receiving the metal blades and grounding prong of an electric plug, two vertical planes 341 respectively provided at periphery of the cylindrical base 34 at two opposite sides corresponding two metal blade insertion slots 32, 32', and a bottom coupling hole 35 provided at the bottom side wall of the cylindrical base 34 for receiving one upright split bolt 12 of the casing 1, and four recessed portions 36 provided at the bottom side wall of the cylindrical base 34 and equiangularly spaced around the bottom coupling hole 35.

The metal conductive strips 4 each comprise a coupling endpiece 41 at one end for securing the conductor of one wire of the three-wire electric wire being inserted into the casing 1, and a plurality of longitudinally spaced coupling units 43, 431, 432 for coupling to the upright hexagonal locating blocks 13 inside the casing 1, each coupling unit 43, 431, 432 comprising a horizontal projecting portion 432, a vertical projecting portion 431, and a coupling hole 43 defined between the horizontal projecting portion 432 and the vertical projecting portion 431 for receiving one upright hexagonal locating block 13. The vertical projecting portion 431 defines with one plane 341 of the corresponding rotary socket body 3 a receiving space for receiving one metal blade of an electric plug.

The grounding strip 5 comprises a coupling endpiece 51 at one end for securing the conductor of one wire of the three-wire electric wire being inserted into the casing 1, a hook 52 at an opposite end for fastening to the recessed retaining hole 15 in the casing 1, a plurality of longitudinally spaced mounting holes 53 for fastening to the upright split bolts 12 inside the casing 1, pairs of upright projecting contact portions 54 longitudinally arranged in a line and respectively disposed at two opposite sides of each mounting holes 53 for receiving the grounding prong of an electric plug, and a plurality of raised portions 55 respectively disposed at two opposite sides of the mounting holes 53 between each two pairs of upright projecting contact portions 54 for engagement with the recessed portions 36 of the rotary socket bodies 3.

The assembly process of the present invention is outlined hereinafter with reference to FIGS. from 1 through 4 again, the metal conductive strips 4 are fastened to the longitudinally grooved positioning blocks 14, 14' and secured to the upright hexagonal locating blocks 13 and arranged in parallel inside the casing 1, permitting the upright hexagonal locating blocks 13 to be respectively plugged into the coupling holes 43 of the metal conductive strips 4, then the grounding strip 5 is mounted inside the casing 1 between the metal conductive strips 4 with its hook 52 hooked in the recessed retaining hole 15, permitting the upright split bolts 12 to be inserted through the mounting holes 53 respectively, and then the rotary socket bodies 3 are respectively fastened to the casing 1 by forcing the bottom coupling holes 35 of the rotary socket bodies 3 into engagement with the upright split bolt 12, Permitting one recessed portion 36 of each socket body 3 to be engaged with one raised portion 55 at the grounding strip 5. After a 3-wire electric wire has inserted through the arched neck 11 into the inside of the casing 1 with the conductors of its three wires respectively fastened to the coupling endpieces 41, 51 of the metal conductive strips 4 and the grounding strip 5, the cover shell 2 is closed on the casing 1 by forcing the peripheral coupling flange 21 of the cover shell 2 into engagement with the peripheral coupling groove 16 of the casing 1, permitting the stop flanges 311 of the rotary socket bodies 3 to be stopped inside the cover shell 2 and the flat circular tops 31 of the socket bodies 3 to be respectively inserted into the socket holes 22 on the cover shell 2. When assembled, the flat circular tops 31 of the rotary socket bodies 3 are maintained in flush with the cover shell 2.

Figure 4:
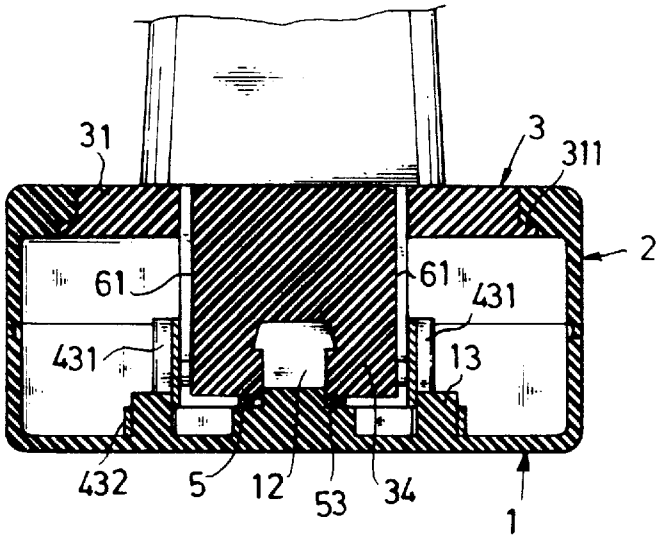
FIG. 4 is transverse view in section of the present invention.
Figure 3:
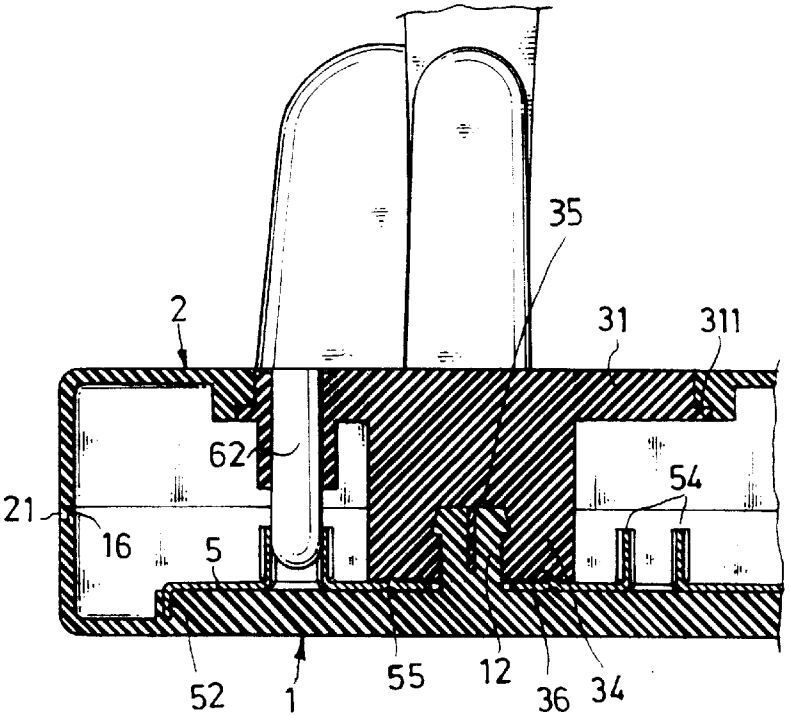
FIG. 3 is a longitudinal sectional view of a part of the present invention.
Figure 5:
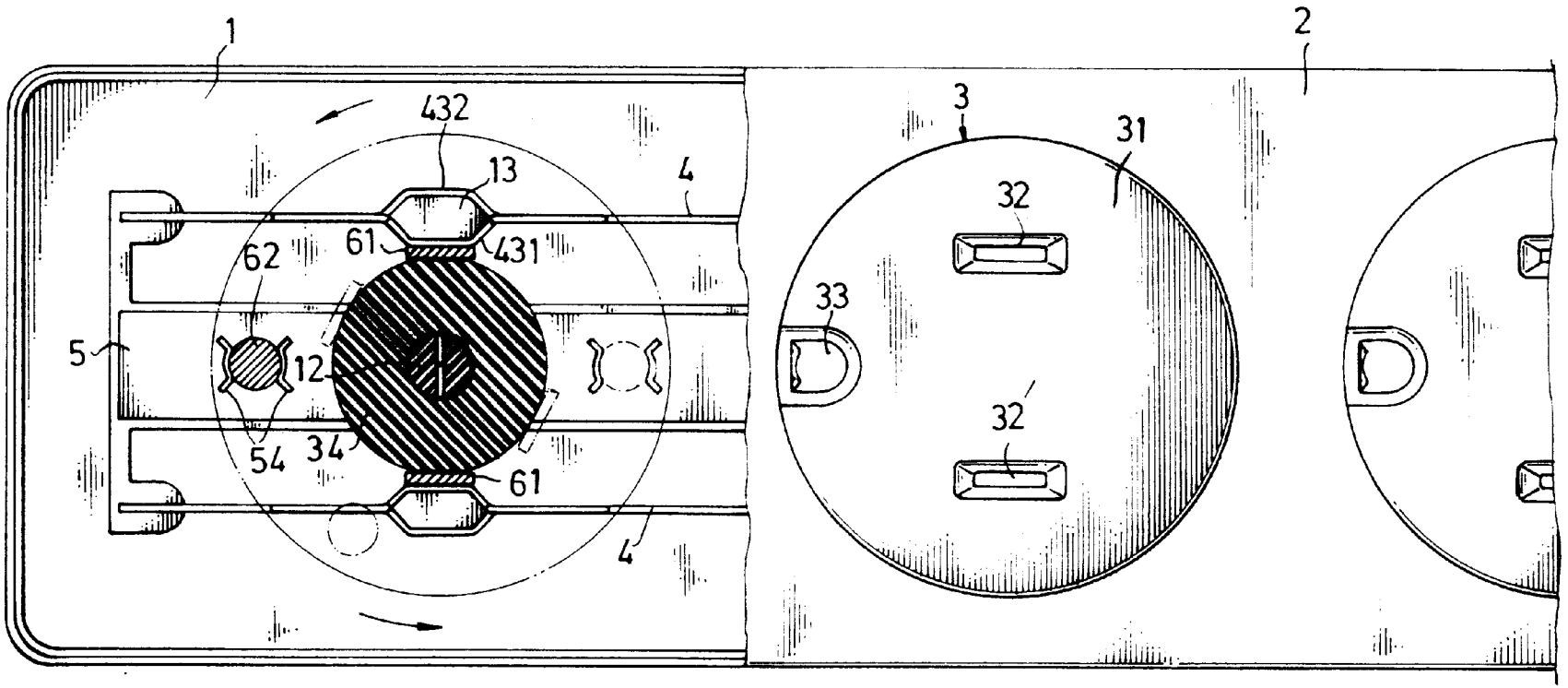
FIG. 5 is a top plain view of the present invention.
Figure 6:
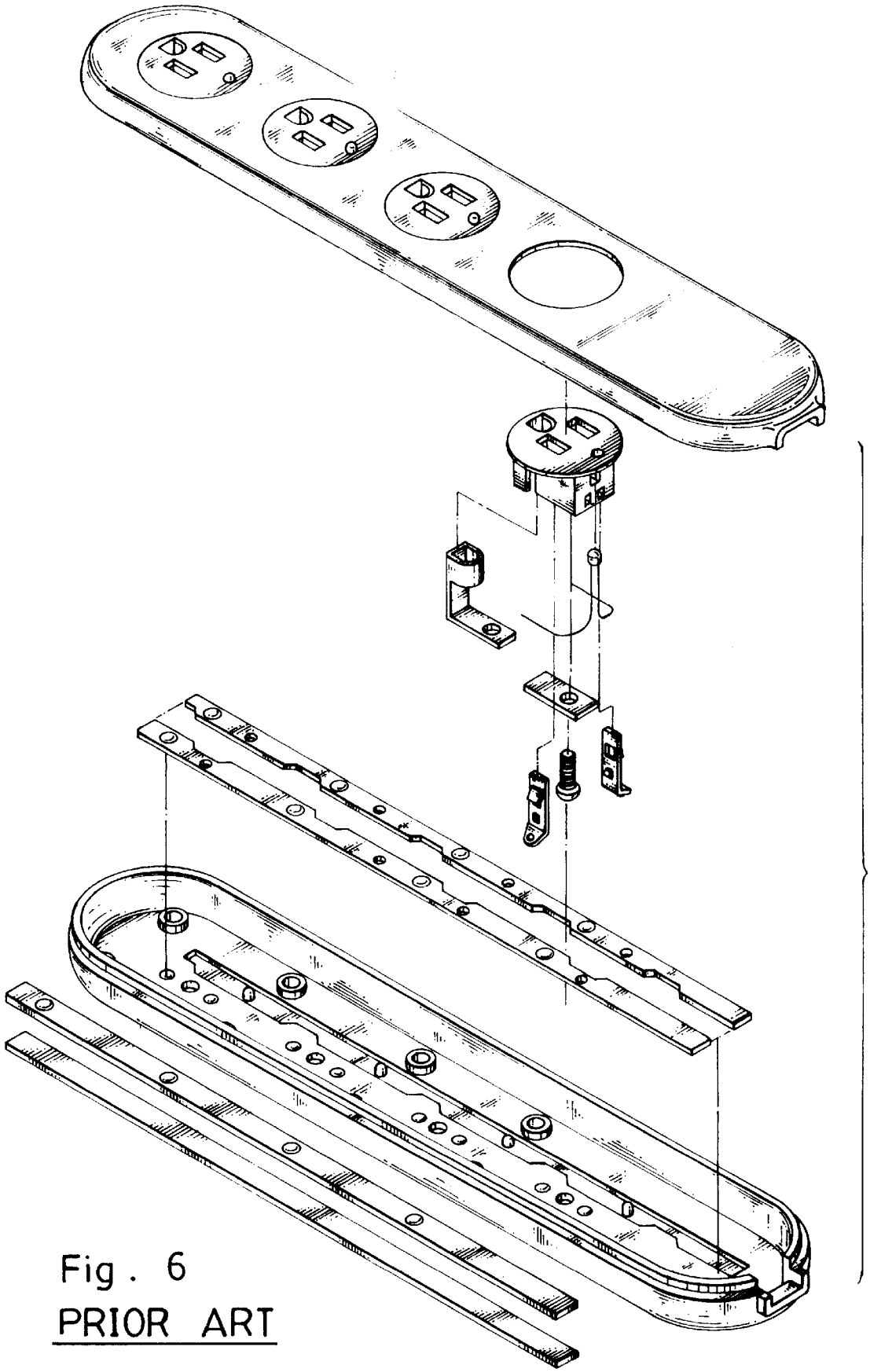
Fig. 6 PRIOR ART
FIG. 6 is an exploded view of an electric outlet according to the prior art.

Referring to FIG. 5 and FIGS. 3 and 4 again, when the metal blades 61 and grounding prong 62 of an electric plug are inserted into the insertion slots 32, 32', 33 at one rotary socket body 3, the metal blades 61 are respectively retained between the vertical planes 341 of the corresponding rotary socket body 3 and the corresponding vertical projecting portions 431 of the metal conductive strips 4, and the grounding prong 62 is retained to one pair of upright projecting contact portions 54 of the grounding strip 5, and therefore the electric plug and the electric outlet are electrically connected, that is the installed electric plug maintained in "ON" position. When the socket body 3 is rotated with the installed electric plug through 90° from "ON" position, the metal blades 61 and the grounding prong 62 are respectively disconnected from the respective vertical Projecting portions 431 and the respective pair of upright projecting contact portions 54, causing the electric plug and the electric outlet to be electrically disconnected, that is the installed electric plug is maintained in "OFF" position. When one socket body 3 is rotated on the corresponding upright split bolt 12, the recessed portions 36 are alternatively forced into engagement with one raised portion 55 of the grounding strip 5 per every 90° angle.

We claim:

1. An electric outlet comprising:

a rectangular top-open casing having a row of male coupling elements on the middle and two longitudinal rows of locating blocks at two opposite sides of said longitudinal row of male coupling elements;

a cover shell covered on said casing, said cover shell having a plurality of socket holes longitudinally arranged in a line;

a plurality of rotary socket bodies respectively mounted in said casing, said rotary socket bodies each having a bottom female coupling means respectively coupled to the male coupling elements of said casing, a flat circular head respectively inserted into the socket holes on said cover shell, and two metal blade insertion slots and one grounding prong insertion slot provided at said flat circular head and adapted to receive the metal blades and grounding prong of an electric plug;

a grounding strip longitudinally mounted in said casing on the middle for connection to the grounding wire of the electric wire to be used with the electric outlet, said grounding strip comprising a plurality of longitudinally spaced through holes, which receive the male coupling elements of said casing, and electric contact means respectively disposed at two opposite sides of each through hole and longitudinally aligned for receiving the grounding prong of an electric plug; and two metal conductive strips mounted in said casing and longitudinally arranged in parallel at two opposite sides of said grounding strip for connection to the hot wire and neutral wire of the electric wire to be used with the electric outlet, said metal conductive strips each having a plurality of longitudinally spaced coupling units respectively coupled to the locating blocks of said casing;

wherein when the metal blades and grounding prong of an electric plug are inserted into the metal blade insertion slots and grounding prong insertion slot of one of said rotary socket bodies, the rotary socket body can be rotated on the respective male coupling element inside said casing and retained between "ON" position to hold the metal blades and grounding prong of the installed electric plug in contact with the coupling units of said metal conductive strips and the electric contact means to said grounding strip, and "OFF" position to disconnect the metal blades and grounding prong of the installed electric plug from the coupling units of said metal conductive strips and the electric contact means of said grounding strip.

2. The electric outlet of claim 1 wherein said rotary socket bodies each have a stop flange raised around the periphery of the respective flat circular head and stopped inside said cover shell.

3. The electric outlet of claim 1 wherein said rotary socket bodies each have four recessed portions equiangularly spaced around the respective bottom female coupling means for positioning on said grounding strip, and said grounding strip has a plurality of raised portions for receiving the recessed portions of said rotary socket bodies to hold said rotary socket bodies in said "ON"/"OFF" position.

4. The electric outlet of claim 1 wherein said rotary socket bodies each have two vertical planes at two opposite sides corresponding to the respective metal blade insertion slots for supporting the metal blades of the installed electric plug in place.

5. The electric outlet of claim 1 wherein the coupling units of said metal conductive strips each comprise a horizontal projecting portion, a vertical projecting portion adapted to contact one metal blade of one electric plug installed in said rotary socket bodies, and a coupling hole defined between said horizontal projecting portion and said vertical projecting portion and coupled to one locating block inside said casing.

6. The electric outlet of claim 1 wherein said electric contact means are pairs of upright projecting contact portions raised from said grounding strip and longitudinally arranged in a line and adapted to receive the grounding prong of an electric plug.

7. The eletric outlet of claim 1 wherein the male coupling elements are upright split bolts.

8. The electric outlet of claim 1 wherein said casing comprises a peripheral top coupling groove, and said cover shell comprises a downward peripheral coupling flanges engaged into the peripheral coupling groove of said casing.

* * * * *